United States Patent [19]

Bast et al.

[11] Patent Number: 4,831,735

[45] Date of Patent: May 23, 1989

[54] ADJUSTMENT HEIGHT CAN OPENER

[75] Inventors: Eleanor A. Bast, West Chicago; Richard K. Thomas, Elk Grove Village, both of Ill.

[73] Assignee: Sunbeam Corporation, Downers Grove, Ill.

[21] Appl. No.: 93,428

[22] Filed: Sep. 4, 1987

[51] Int. Cl.[4] ..... B67B 7/70; B67B 7/82

[52] U.S. Cl. ..... 30/433; 30/410; 30/419; 30/424; 30/426

[58] Field of Search ..... 30/400, 408, 410, 416, 30/433, 434, 436, 448, 424, 426

[56] References Cited

U.S. PATENT DOCUMENTS

| | | | |
|---|---|---|---|
| 528,371 | 10/1894 | Keller | 30/433 |
| 778,112 | 12/1904 | Church et al. | 30/433 |
| 2,579,189 | 12/1951 | Jenson | 30/410 |
| 2,579,912 | 12/1951 | Donnelly | 30/448 |
| 3,002,274 | 10/1961 | Jepson et al. | 30/410 |
| 3,348,305 | 10/1967 | Biclak | 30/410 |
| 4,561,182 | 12/1985 | Yamamoto et al. | 30/433 |

*Primary Examiner*—Frank T. Yost
*Assistant Examiner*—Michael D. Folkerts
*Attorney, Agent, or Firm*—Neil M. Rose

[57] ABSTRACT

An electrically operated portable can opener being adjustable in height to enable opening various size cans, the can opener having a primary housing which is partially received within a secondary base housing with a rotary cam serving to control the raising and lowering of the primary housing with respect to the base housing.

11 Claims, 2 Drawing Sheets

ADJUSTMENT HEIGHT CAN OPENER

FIELD OF THE INVENTION

This invention relates generally to electric can openers for domestic use and more specifically to a domestic electric can opener having a means for adjusting the heights so that it may open any of the currently available cans in which food is distributed for domestic consumption.

BACKGROUND OF THE INVENTION AND PRIOR ART

The domestic can opener has been popular and widely accepted as a kitchen appliance. In spite of the fact that consumers have been switching from canned to frozen foods, there are still a sufficient number of foods sold in cans for the average consumer to regard the electric can opener as one of the essential or basic electric appliances for the kitchen. The availability of high strength, molded plastics and small powerful electric motors has increased the manufacturers options insofar as styling and functions are concerned. Because of the highly competitive nature of the can opener business and the number of different suppliers involved, there has been a trend toward increasing the features or functions performed by the domestic electric can opener or attempting to in some way make the appliance more appealing to the consumer than the competitors' product. Although it is technically feasible to manufacture a very small can opener which is powerful enough to open the cans normally available to the householder, it is important that the can opener be adapted to conveniently accept even the large size cans such as those containing coffee or juice. This has resulted in many manufacturers constructing can openers which are tall and somewhat awkward looking, even though the increased height to accommodate the tall cans is only required on infrequent occasions.

This situation has prompted some manufacturers to make electric can openers which are hand operated, and therefore, need not be tall enough to accommodate the tallest cans while standing on the counter. In general, these hand operated can openers have the disadvantage that the user must hold and guide the can opener with respect to the can during the entire process of severing the lid from the can. Another approach has been to make the can opener wall mounted where it may be spaced any desired height above the counter or other obstruction. The consumer has in general not been receptive to the concept of wall mounting an appliance such as a can opener. A third general alternative is disclosed in the patent to Yamamoto, et al. U.S. Pat. No. 4,561,182 in which the can opener may be either wall mounted or stand mounted with the capacity for changing the height of the can opener to suit various conditions. The instant invention is concerned with a can opener having a simplified mechanism for adjusting the height of the can opener.

BRIEF DESCRIPTION OF THE INVENTION

The present invention involves an adjustable height can opener having a primary housing including a lower end which is telescopically received within a secondary housing or base. Control means are provided on the base to move the primary housing upwardly or downwardly with respect to the secondary housing. This control mechanism includes a knob associated with a cam mounted on the secondary housing and engageable with a follower on the primary housing to raise and lower the primary housing. In the lowered position, the upper and lower housings have abutting shoulders which provide rigid support and give the can opener the appearance of a conventional, nonadjustable can opener. In the raised position, the telescopic engagement of the housing walls as well as the stop projections on the engaged walls provide adequate rigidity. The simple control knob may be adjusted with one hand while the other hand manipulates the can to be opened.

It is an object of the present invention to provide an improved portable electric can opener which is adjustable or variable in height to accommodate cans of different size.

It is another object of the present invention to provide an adjustable height can opener which has a primary housing which is telescopically received in a secondary or base housing to provide for an adjustable height can opener.

Further objects and advantages of the instant invention will become obvious to one skilled in the art as the following description proceeds, and the features of novelty which characterize the invention will be pointed out in the claims annexed to and forming a part of the specification.

BRIEF DESCRIPTION OF THE DRAWINGS

Referring to FIG. 1, there is shown a can opener generally designated by the reference numeral 11. The can opener 11 which is shown in FIGS. 1, 2 and 3 in its lowered position includes a primary housing 13 and a secondary or base housing 15. The secondary housing 15, as is best shown in FIGS. 5, 6 and 7, is of generally box-like configuration having a top opening into which the lower end of the primary housing 13 extends. The lower end portion of the primary housing 13 is shaped to conform to the interior of the secondary housing 15 so that the parts may be telescoped together with the primary housing 13 being mounted for limited vertical sliding movement with respect to the secondary housing 15.

Figure 1:
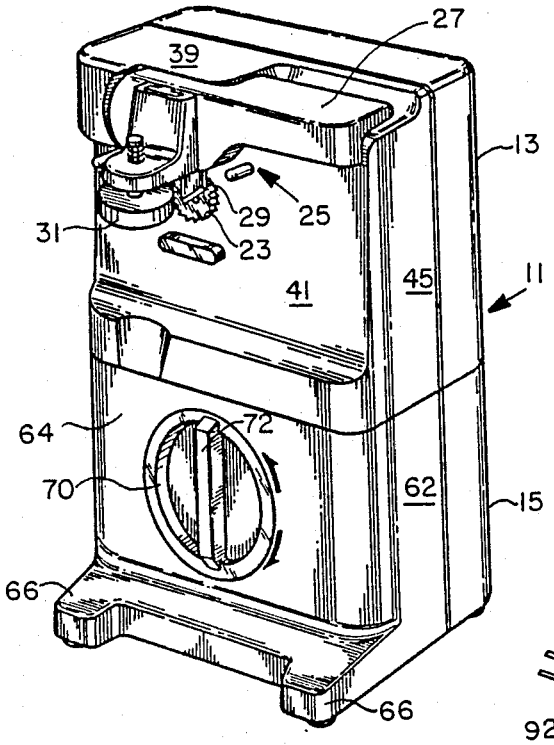
FIG. 1 is a perspective view of a can opener embodying our invention.

The can opener 11 includes within the primary housing 13 a motor 17, and reduction gearing 19 having an output shaft 21 which supports a serrated can feed or rotation wheel 23. Associated with the exterior of the primary housing 13 is a cutter assembly 25 which includes a pivotally mounted operating lever 27 which supports a cutter or plow 29. The cutter assembly 25 also includes a lid holding magnet 31.

Figure 2:
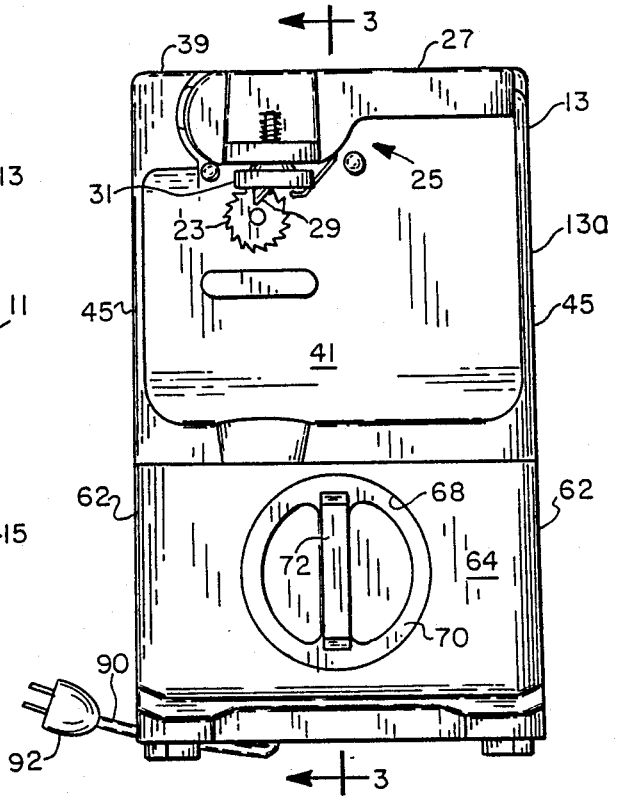
FIG. 2 is a front elevational view of the can opener of FIG. 1.

In order to open a can, the operating lever 27 is pivoted upwardly, lifting the right end as shown in FIG. 2 which in turn raises the cutter 29 with respect to the feed wheel 23. The can to be opened is then moved against the front of the can opener with its axis in a generally vertical position and the upper lip or inseam of the can overlying the serrations on the feed wheel 23. The lever 27 is then rotated back to the position shown in FIGS. 1 and 2 which causes the cutter to be moved against the lid of the can. Associated with the lever 27 are switch means which energize the motor 17 which in turn drives the feed wheel 23 to rotate the can in engagement with the cutter 29 thereby severing the lid from the can after it has rotated 360 degrees. At that time the magnet 31 retains the lid so that it does not fall down within the can. The above described automatic can opener mechanism is conventional.

The can opener 11 is also conventional in having a knife sharpening abrasive wheel 33 supported directly on a shaft 35 driven directly by the motor 17. Suitable slots 37 and 38 are provided in the primary housing 13 to provide access to the abrasive wheel 33 by knife blades and scissor blades. This arrangement of the grinding wheel 33 with its beveled edges and the various access slots 37 and 38 are also conventional and known in the art, forming no part of the present invention. The primary housing 13 is formed with an upper portion **13*a* which has a top wall 39, front wall 41, a back wall 43 and side walls 45**.

Figure 4:
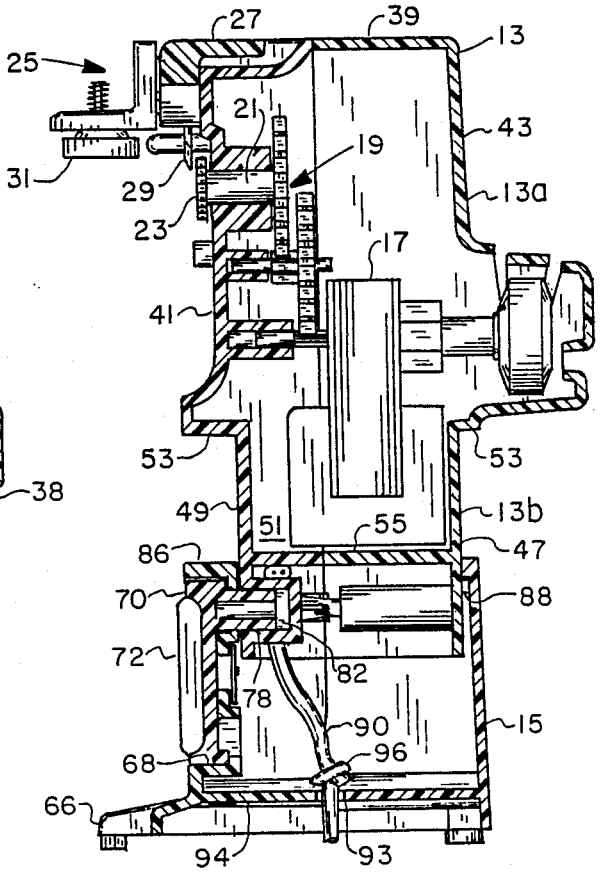
FIG. 4 is a sectional view similar to FIG. 3 but showing the can opener in its raised position rather than the lowered position shown in FIG. 3.

Extending downwardly from the upper portion **13*a* of the primary housing 13 there is a lower end portion 13*b* which is best shown in FIG. 4. The lower end portion 13*b* is defined by vertical walls including a rear wall 47, a front wall 49 and opposite side walls 51, one of which is shown in FIG. 4. As is evident from FIG. 4, the walls 47, 49 and 51 on the lower end portion 15*b* are offset inwardly from the walls of the upper portion of the primary housing with there being a downwardly facing shoulder 53 which is defined by a wall interconnecting the upper housing portion 13*a* with the lower housing portion 13*b*. Also provided in the lower end portion 13*b* of the primary housing 13 is a bottom wall 55 which completes the enclosure within which the motor 17 and the reduction gearing 19** are mounted.

Figure 3:
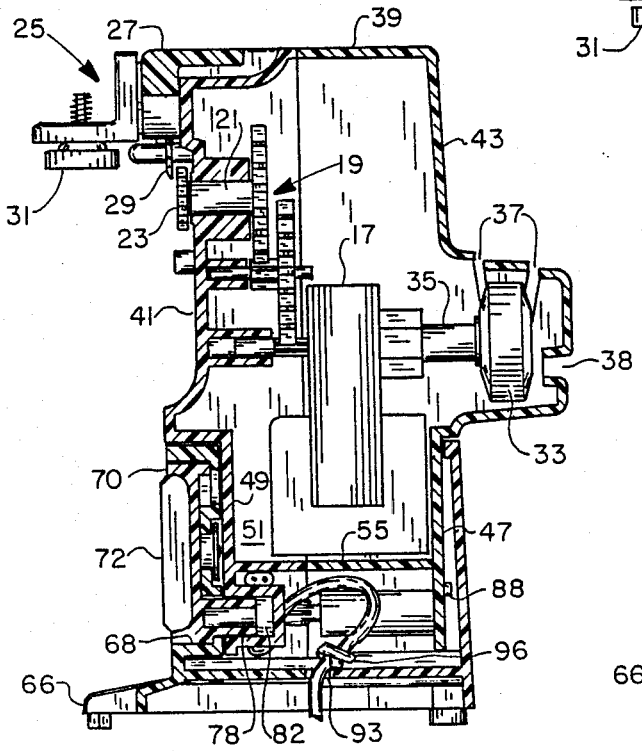
FIG. 3 is a vertical sectional view taken generally along lines 3—3 of FIG. 2.
Figure 5:
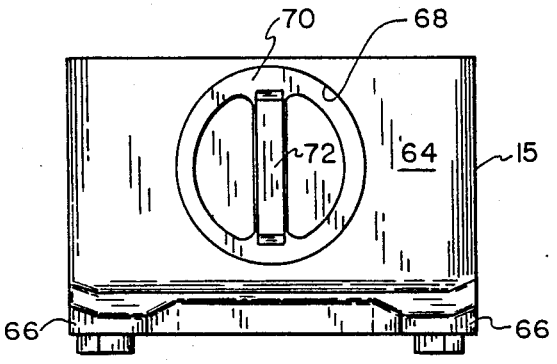
FIG. 5 is a front elevational view of the secondary or base housing which receives and supports the primary housing enclosing the can opener mechanism.

The secondary or base housing 15 is formed by a pair of plastic molded members including a front member **15*a* and a rear member 15*b* which are secured together by screws (not shown) to form a box-like member having a top opening 15*c*. The front and rear members 15*a* and 15*b* provide a rear wall 60, side walls 62 and a front wall 64. Associated with the front member 15*a* and the front wall 64 are outwardly projecting stabilizers 66 which are designed to prevent the can opener 11 from tipping forward either from the force applied by an operator to the lever 27 or as a consequence of the can being opened. The front wall 64 of the secondary housing 15 is formed with a cylindrical pocket 68 within which there is mounted a control knob 70 as shown in FIGS. 3 and 4. As best shown in FIGS. 1 and 5, the control knob 70 has a diametrically extending bar 72 which may be easily lifted by the operator to rotate the knob 70. The recess 68 terminates in a wall 74 (FIG. 7) on which the knob 70 is mounted for rotation about a horizontal axis by screw 76 which extends through an opening in the wall 74 into threaded engagement with the knob 70**.

The knob 70 is a generally flat cylindrically shaped disc having a pin or projection 78 extending from one edge thereof in a direction parallel with the horizontal axis of rotation. As may best be seen in FIG. 7, the pin 78 extends through an arcuate slot 80 formed in the wall 74. The slot 80 extends just slightly more than 180 degrees around the screw 76 or the horizontal axis on which the knob 70 rotates. With the pin 78 moving in the slot 80, the ends of the slot 80 limit the rotation of the knob 70 to slightly more than 180 degrees.

The purpose of the pin 80 is to serve as a cam which is to be used to raise and lower the primary housing 13 with respect to the secondary housing 15. To function as a cam follower, the lower end portion **13*b* of the primary housing 13 is formed with a forwardly facing slot or pocket 82 which has a width slightly greater than the diameter of the pin 78, there being sufficient clearance so that the pin 78 may easily slide lengthwise within the slot 82. As may best be seen in FIG. 3, the pin 78 is initially engaged in the slot 82 when the pin 78 is in its lowermost position. When the knob 70 is rotated to its limit to the upper position shown in FIG. 4, the camming action of the pin 78 with respect to the slot 82 raises the primary housing 13 to the position shown in FIG. 4** where the can opening mechanism is sufficiently elevated to accommodate the larger size can.

In the uppermost position of the primary housing 13, as shown in FIG. 4, the pin 78 supports the entire weight of the can opener and the load including the load applied by the operator and the weight of the can being opened. In order to assure that the force acting downwardly on the pin 78 does not cause the knob 70 to rotate back to the position shown in FIG. 3, the pin 78 is moved over center as far as the pivotal mounting of the knob 70 is concerned so that the force tends to urge the pin 78 to the end of the slot 80 and not back to the position shown in FIG. 3. To better understand this relationship, reference should be had to FIG. 6 which shows in solid lines the position of the pin 78 when it is in its lowermost position as shown in FIGS. 3 and 7. Then, when the knob 70 is rotated through 180 degrees to the raised position of the pin 78, the pin appears in the position shown in dotted lines in FIG. 6 which is on the other side of the pivot axis for the knob 70, as shown by the center line in FIG. 6. If a vertical plane were placed through the pivot axis of the knob 70, the pin 78 starts out on one side of the plane and in the raised position is on the other side of this imaginary vertical plane. Thus, if viewing the pin as it may be seen in FIG. 7, when the pin 78 moves to the uppermost position to the far end of the slot 80 from the position shown in FIG. 7, then any downward force on the pin 78 exerted by the primary housing 13 tends to cause the pin 78 and the knob 70 to rotate clockwise, as shown in FIG. 7, or toward the near end of the slot which tends to maintain the primary housing 13 in the raised position.

Figure 6:
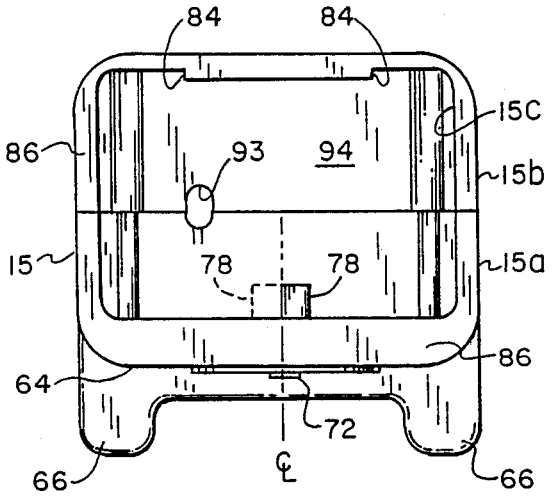
FIG. 6 is a top plan view of the secondary housing.
Figure 7:
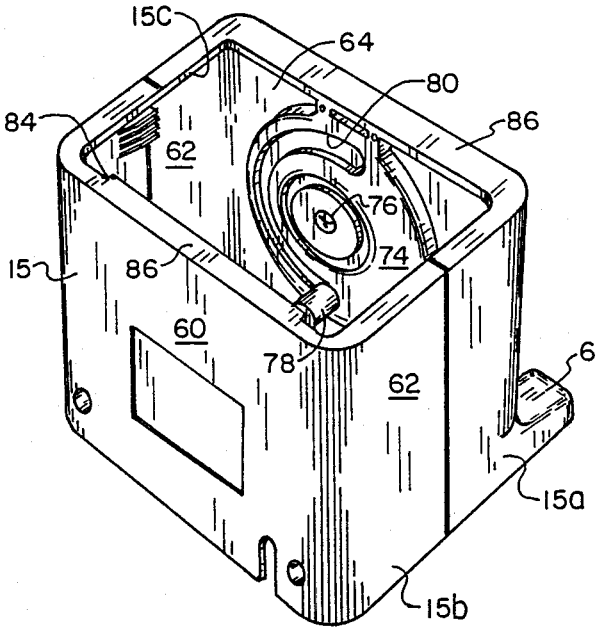
FIG. 7 is a top perspective view of the secondary housing showing the cam which raises and lowers the primary housing.

In order to assure that the primary housing 13 moves vertically and does not twist with respect to the secondary housing 15, there are provided inwardly directed notched walls 84, as best shown in FIG. 6, which cooperate with corresponding notched walls in the lower end portion **13*b* of the primary housing 13. Around the periphery of the opening 15*c*, the walls snugly engage the vertical walls 47, 49 and 51 of the lower end portion 13*b*. In the lowermost position of the primary housing 13 the downwardly facing shoulder 53 normally engages an upwardly facing shoulder 86 which actually forms the top of the walls 60, 62 and 64**.

Figure 8:
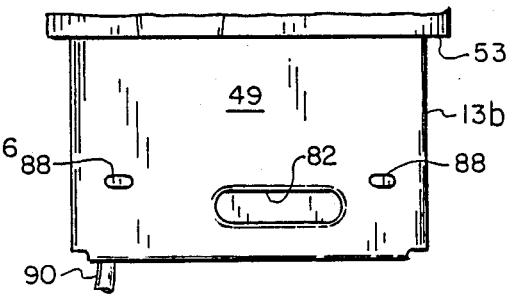
FIG. 8 is a fragmentary front elevational view of the portion of the primary housing that is received within the base housing.

In order to prevent the primary and secondary housings from being detached from each other and to increase the rigidity of the can opener in the uppermost position of the primary housing, the front and rear walls 49 and 47 are formed with small protuberances 88 which, in the uppermost position shown in FIG. 4, engage under the wall defining the shoulder 86, as is best shown in FIGS. 4 and 8. This engagement tends to prevent the primary housing from rocking or becoming misaligned with respect to the secondary housing 15, even though the primary support is provided only by the pin 78 in engagement with the slot or pocket 82.

The can opener 11 is provided with a conventional power cord 90 which includes a plug 92 on one end suitable for connection to a utility line outlet. The power cord 90 extends into an opening 93 formed in bottom wall 94 of the secondary housing 15. The cord then extends upwardly through an opening (not shown) in the wall 55 into the primary housing 13. The amount of slack in the cord 90 permits the relative movement between primary housing 13 and the secondary housing 15 with the slack merely being contained within the space between the bottom wall 94 of the secondary housing 15 and the wall 55 in the primary housing 13. To assure that sufficient slack in cord 90 is maintained within the housing to permit the primary housing 13 to move to the raised position, the cord 90 is provided with a knot 96 above the wall 94 which will not pass through opening 93. This arrangement provides a simple and convenient means of accommodating the power cord to the adjustable height design.

As may best be seen in FIG. 1, the can opener 11 in its lowered position has the base and shoulders 53 and 86 on the primary and secondary housings in abutting relationship with the side walls of the two housings being in vertical alignment providing a smooth, attractive contour for the can opener 11. When the need arises to open a large coffee or juice can, the user may with one hand rotate the knob 70, causing the primary housing 13 to move to its elevated position shown in FIG. 4. The overcenter position of the pin 78 effectively locks the two housings in their relative raised positions, thereby permitting the user to immediately proceed to open the can. After the can has been opened, the knob 70 may be rotated again to move the primary housing 13 to its lowered position so that the can opener again becomes compact and suitable for conveninet storage.

Obviously, many modifications and variations of the present invention are possible in light of the above teachings. Thus, it is to be understood that, within the scope of the appended claims, the invention may be practiced otherwise than as specifically described above.

What is claimed and desired to be secured by Letters Patent of the United States is:

1. An electric can opener comprising, a primary housing enclosing a motor and reduction gearing, a feed wheel on said primary housing driven by said reduction gearing and positioned to rotate a can to be opened, a cutter mounted on said primary housing for manual actuation into and out of engagement with said can, a secondary housing having a supporting base and an upwardly facing recess, said primary housing having a lower end portion which is telescopically received within said recess, complementary walls on said lower end portion and said secondary housing guiding said primary housing for vertical movement with respect to said secondary housing between a raised position and a lowered position, acutator means on said secondary housing being rotatable to drive said primary housing between said positions, said actuator means including a rotatable cam mounted for rotation about a fixed horizontal axis, said cam having means engaging and supporting said primary housing, said cam being rotatable in a first direction to raise said primary housing and in the opposite direction to lower said primary housing, the weight of said primary housing in said raised position urging said cam in said first direction.

2. The can opener of claim 1 wherein said rotatable cam engages a cam follower on said primary housing, said cam having a projection which engages said follower and which moves on a semi-circular path concentric with the axis of rotation of said cam.

3. The can opener of claim 2 wherein said cam comprises a rotatable disc mounted for rotation on said secondary housing and having said projection extending through an arcuate slot in said secondary housing into said recess for engagement with a horizontal slot formed in the lower end portion of said primary housing.

4. An electric can opener comprising, a primary housing enclosing a motor and reduction gearing, a feed wheel on said primary housing driven by said reduction gearing and positioned to rotate a can to be opened, a cutter mounted on said primary housing for manual actuation into and out of engagement with said can, a secondary housing having a supporting base and an upwardly facing recess, said primary housing having a lower end portion which is telescopically received within said recess, complementary walls on said lower end portion and said secondary housing guiding said primary housing for vertical movement with respect to said secondary housing between a raised position and a lowered position, actuator means on said secondary housing being rotatable to drive said primary housing between said positions, said actuator means comprising a rotatable cam which engages a cam follower on said primary housing, said cam having a projection which engages said follower and which moves on a semicircular path concentric with the axis of rotation of said cam, said follower exerting a vertical downward force on said porjection in said raised position of said primary housing, said downward force in the raised position of said primary housing urging said cam in a direction of rotation opposite to that required to move said cam follower and said primary housing to said lowered position.

5. An electric can opener comprising a primary housing enclosing a motor and reduction gearing, a manually operable can opening mechanism mounted on the outer surface of said primary housing and driven by said reduction gearing, a secondary housing having side walls and a bottom wall defining a box with an open top, said primary housing having a lower end portion which is received within said secondary housing, the adjacent walls of said primary and secondary housing guiding said primary housing for limited vertical movement with respect to said secondary housing, said primary housing having substantially vertical side walls with outer surfaces which are coplanar with the outer surface of said secondary housing side walls, said lower end portion of said primary housing having inwardly offset vertical walls which are separated from said substantially vertical side walls by a horizontal downwardly facing shoulder extending completely around said primary housing, said secondary housing side walls terminating at their upper edges in a horizontal shoulder which abuts said primary housing shoulder when said primary housing is in its lowered position, means operable manually by one hand for raising and lowering the height of said primary housing by sliding said lower end portion with respect to said secondary housing, said secondary housing being formed by two molded plastic parts which abut along a substantially vertical plane to form a vertical guideway which is substantially rectangular in horizontal section, and a power cord with a plug on one end and having the other end extending into said lower end portion of said primary housing into connection with said motor, said cord extending from said lower end portion through an opening formed in said bottom wall of said secondary housing.

6. The electric can opener of claim 5 wherein the portion of said cord extending between the lower end portion of said primary housing to said opening formed in said bottom wall is sufficiently long to accommodate movement of said primary housing to the raised position, a knot in said cord above said bottom wall which prevents movement of said cord outwardly through said opening in said bottom wall.

7. The electric can opener of claim 5 wherein said opening formed in said bottom wall is formed in part in each of said plastic parts.

8. The electric can opener of claim 5 wherein said manually operable means comprises a knob mounted for rotation about a horizontal axis on one of said housings and having a pin mounted eccentrically with respect to said axis of rotation of said knob, a horizontally extending slot in the other of said housing being engaged by said pin, rotation of said knob moving said primary housing between a raised position and a lowered position.

9. An electric can opener comprising a primary housing enclosing a motor and reduction gearing, a manually operable can opening mechanism mounted on the outer surface of said primary housing and driven by said reduction gearing, a secondary housing having side walls and a bottom wall defining a box with an open top, said primary housing having a lower end portion which is received within said secondary housing, the adjacent walls of said primary and secondary housing guiding said primary housing for limited vertical movement with respect to said secondary housing, said primary housing having substantially vertical side walls with outer surfaces which are coplanar with the outer surface of said secondary housing side walls, said lower end portion of said primary housing having inwardly offset vertical walls which are separated from said substantially vertical side walls by a horizontal downwardly facing shoulder extending completely around said primary housing, said secondary housing side walls terminating at their upper edges in a horizontal shoulder which abuts said primary housing shoulder when said primary housing is in its lowered position, means operable manually by one hand for raising and lowering the height of said primary housing by sliding said lower end portion with respect to said secondary housing, said manually operable means comprising a knob mounted for rotation about a horizontal axis on one of said housings and having a pin mounted eccentrically with respect to said axis of rotation of said knob, a horizontally extending slot in the other of said housings being engaged by said pin, rotation of said knob moving said primary housing between a raised position and a lowered position, said knob being mounted in a cylindrical recess in one of said secondary housing side walls, said cylindrical recess having a bottom defined by a vertical wall on which said knob is pivotally mounted, said recess bottom having an arcuate slot formed therein through which said pin extends, said horizontal slot being formed in said lower end portion of said primary housing with a width slightly greater than the diameter of said pin, said pin extending into said horizontal slot to raise and lower said primary housing as said knob is rotated.

10. The electric can opener of claim 9 wherein said arcuate slot limits rotation of said knob to approximately 180 degrees, in the raised position of said primary housing said pin in said arcuate slot being on the other side of a vertical plane through the axis of rotation of said knob from the side of said plane in which said pin moves in going to said lower position of said primary housing.

11. An electric can opener comprising a primary housing enclosing a motor and reduction gearing, a manually operable can opening mechanism mounted on the outer surface of said primary housing and driven by said reduction gearing, a secondary housing having side walls and a bottom wall defining a box with an open top, said primary housing having a lower end portion which is received within said secondary housing, the adjacent walls of said primary and secondary housing guiding said primary housing for limited vertical movement with respect to said secondary housing, said primary housing having substantially vertical side walls with outer surfaces which are coplanar with the outer surface of said secondary housing side walls, said lower end portion of said primary housing having inwardly offset vertical walls which are separated from said substantially vertical side walls by a horizontal downwardly facing shoulder extending completely around said primary housing, said secondary housing side walls terminating at their uper edges in a horizontal shoulder which abuts said primary housing shoulder when said primary housing is in its lowered position, means operable manually by one hand for raising and lowering the height of said primary housing by sliding said lower end portion with respect to said secondary housing, said secondary housing being formed by two molded plastic parts which abut along a substantially vertical plane to form a vertical guideway which is substantially rectangular in horizontal section, and a power cord with a plug on one end and having the other end extending into said lower end portion of said primary housing into connection with said motor, said cord extending from said lower end portion through an opening formed in said bottom wall of said secondary housing, said inwardly offset vertical walls of said lower end portion of said primary housing being formed with a plurality of outwardly extending projections which engage said secondary housing under said horizontal shoulder of said secondary housing to limit upward movement of said primary housing with respect to said secondary housing.

* * * * *